United States Patent [19]

Fujimatsu et al.

[11] 4,299,914

[45] Nov. 10, 1981

[54] METHOD FOR FORMING A CYAN DYE IMAGE

[75] Inventors: Wataru Fujimatsu; Yasushi Usagawa; Osamu Sasaki; Katsumi Matsuura, all of Hino, Japan

[73] Assignee: Konishiroku Photo Industry Co., Ltd., Tokyo, Japan

[21] Appl. No.: 145,684

[22] Filed: May 1, 1980

[30] Foreign Application Priority Data

May 7, 1979 [JP] Japan ..... 54/55380

[51] Int. Cl.[3] ..... G03C 7/00

[52] U.S. Cl. ..... 430/384; 430/385; 430/552; 430/553; 430/558

[58] Field of Search ..... 430/384, 385, 552, 553, 430/558

[56] References Cited

U.S. PATENT DOCUMENTS

| | | | |
|---|---|---|---|
| 2,484,477 | 10/1949 | Weissberger et al. | 430/552 |
| 2,772,162 | 11/1956 | Salminen et al. | 430/552 |
| 3,880,661 | 4/1975 | Lau et al. | 430/553 |
| 4,124,396 | 11/1978 | Osborn | 430/553 |

*Primary Examiner*—J. Travis Brown

*Attorney, Agent, or Firm*—Bierman & Bierman

[57] ABSTRACT

A method for forming a cyan dye image by development of an exposed silver halide photographic material with a developer containing a cyan coupler of the following formula:

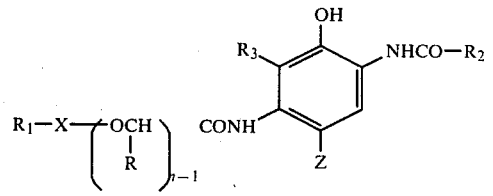

in which R represents hydrogen atom or an alkyl group having a carbon number of one to twenty; $R_1$ represents an alkylsulfonamide or alkylsulfamoyl group; $R_2$ represents an alkyl, aryl group or a 5 or 6-membered heterocyclic group containing a nitrogen, oxygen or sulfur atom; $R_3$ represents a hydrogen or halogen atom; X represents an alkylene, metaphenylene or orthophenylene group; Z represents a hydrogen atom or a split-off radical; and n has an integral value of one or two.

26 Claims, No Drawings

METHOD FOR FORMING A CYAN DYE IMAGE

The present invention relates to a cyan coupler and a method to form a cyan dye image, particularly to the method to form a cyan dye image by means of color developing a silver halide color photographic sensitive material in the presence of 2,5-diacyl amino type cyan coupler.

As for the fundamental natures required for a coupler, it is desired to have various characteristics such as not only simple color dye forming, but high dissolubility into an organic solvent having a high boiling point or to alkali, and satisfactory dispersibility and stability in silver halide photographic emulsion, and durability against light, heat, moisture etc, favorable spectral absorption characteristics, clear transparency, high color density and further sharpness of a dye image to be obtained thereby. Above all, it is required the improvements of image preservability such as heat resistance, moisture resistance, light resistance etc., in cyan coupler.

Further, it becomes a serious issue from the viewpoint of the recent antipollution measures to remove benzyl alcohol which is to be added in a color developer. However, if a color developer containing no benzyl alcohol brings about such a disadvantage that the color developability of a coupler added into silver halide photographic emulsion, (e.g. the color dye forming speed and the maximum color density thereof,) is generally lowered. And the above disadvantage is remarkable in cyan coupler. Therefore, it is now earnestly desired that the color developability of cyan coupler does not depend upon benzyl alcohol, and the studies for improvement thereof are being carried out along with the improvements of the said image preservability. However, so far as the present inventor knows of the cyan couplers which have so far been known, it is not yet found any coupler which satisfy all of the properties required as above.

That is, the following cyan couplers having so far been known are given. For example, the following coupler as described in the U.S. Pat. No. 2,801,171;

6-[α-(2,4-di-tert-amylphenoxy)butaneamide]-2,4-dichloro-3-methylphenol is, as is obvious from the underdescribed examples, excellent in light resistance, but has a defect in heat resistance, and in addition, the color development thereof is largely dependent upon benzyl alcohol and the maximum color density thereof is insufficient in the color developing solution out of which benzyl alcohol is removed.

And, the coupler as described in the Japanese Patent Laid-Open-to-Public publication No. 53-109630 is the one that dicarbonylamino group is substituted to the 2 and 5 positions of phenol, and the dispersion stability at the time of coating or finishing thereof has been improved by that the end of the substituent at the 5 position inducts p-alkylsulfonylaminophenoxy group or p-alkylaminosulfonylphenoxy group, that is described therein, but, as is obvious from the examples described hereunder, the developability of the said coupler is still dependent largely upon benzyl alcohol, therefore it is desirable to improve the above point.

Further, as described in the U.S. Pat. No. 3,839,044, Japanese Patent Publication No. 48-36894, the Japanese Patent L-O-P publication Nos. 47-37425, 50-130441, 50-108841, 50-120334, etc., and as is obvious from the examples described hereunder, the phenol type cyan couplers do not satisfy the required properties thereof, because the problems remain in the heat resistance thereof, or the color dye forming speed and the maximum color density are insufficient in color developer containing no benzyl alcohol.

The first object of the invention is to provide a cyan coupler having the desirable properties requested for the cyan coupler as above described. The second object of the invention is to provide a cyan coupler having the high dissolubility in alkali or organic solvent having a high boiling point and the superb dispersiveness and stability in silver halide color photographic emulsion. The third object of the invention is to provide an image forming method of cyan coupler of which image preservability, i.e., heat resistance, light resistance and antihumidity, are superior, and also color dye forming speed thereof in color developing solution out of which benzyl alcohol is removed is faster, and further it gives a cyan dye image having a high color density.

The above described objects and the other objects as described hereunder can be achieved by a cyan coupler as shown in the following general formula [1],

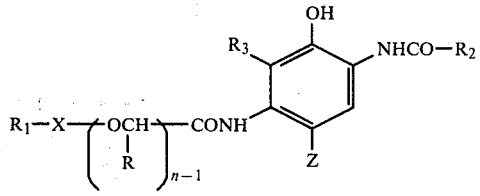

[1]

(In which R represents a hydrogen atom or alkyl group having a carbon number of one to twenty; $R_1$ represents an alkylsulfonamide or alkylsulfamoyl group; $R_2$ represents an alkyl, aryl or hetero cyclic group; $R_3$ represents hydrogen or halogen atom; X represents an alkylene, metaphenylene or orthophenylene group; Z represents a hydrogen atom or coupling split-off radical; and n has an integral value of one or two.)

Further, the group represented by $R_1$ may have a substituent, which is selected from an aliphatic hydrocarbon, aryl, 5 or 6 membered hetero cyclic group. The aliphatic hydrocarbon group includes either saturated or unsaturated one which may be straight or branched, or ring-formed, and preferably, it is an alkyl group (e.g., methyl, ethyl, isobutyl, dodecyl, octadecyl, cyclobutyl, cyclohexyl) or an alkenyl group (e.g., allyl). As for the aryl group, a phenyl or naphthyl group is given as the examples. The heterocyclic group is one containing a nitrogen, oxygen or sulfur atom, whose example is pyridinyl, quinolyl, thienyl, piperidyl, imidazolyl. And as for the substituent which may be introduced into the above-mentioned substituent (an aliphatic hydrocarbon, aryl or heterocyclic group) the following examples are given such as a halogen atom, a nitro, hydroxy, carboxyl, amino, substituted amino, sulfo, alkyl, alkenyl, aryl, heterocyclic ring (5 or 6-membered and containing a nitrogen, oxygen or sulfur atom), alkoxy, aryloxy, arylthio, arylazo, acylamino, carbamoyl, ester, acyl, acyloxy, sulfonamide, sulfamoyl, sulfonyl or morpholino group.

As for the more concrete examples of $R_2$, among which, the example of the alkyl group is given as methyl, ethyl, isopropyl, butyl, ter-butyl, dodecyl, pentadecyl, cyclohexyl, etc., the example of the aryl group is given as phenyl, naphthalene, etc., the example of the heterocyclic group is given as furan group, etc. Further, the examples of a substituent which may be introduced into the above group is given as halogen atom (i.e., chlorine, bromine, fluorine), a nitro, hydroxy, carboxy, amino, sulfo, cyano, alkoxy, aryloxy, arylthio, acylamino, carbamoyl, ester, acyl, acyloxy, sulfonamide, sulfamoyl, sulfonyl, sulfoxy or oxysulfonyl.

And, the concrete examples of alkylene group among X groups described above are given as the groups of methylene, ethylene, butylene, etc., and further alkylene group, and the above mentioned metaphenylene and orthophenylene groups may be substituted with the following group; for example, an alkyl (methyl, ethyl, isobutyl, dodecyl, tert-acyl, cyclohexyl, pentadecyl, etc.), alkenyl (allyl, etc.), aryl, heterocyclic, nitro, hydroxy, carboxy, amino, sulfo, alkoxy, aryloxy, arylthio, acylamino, carbamoyl, ester, acyl, acyloxy, sulfonamide, sulfamoyl, sulfonyl or morpholino group, or a halogen atom.

And, R represents hydrogen atom or alkyl group having a carbon number of one to twenty, and the concrete examples of the said alkyl groups are given as each group of methyl group, ethyl group, butyl group, dodecyl group, etc.

A concrete example of the coupling split-off radical for Z includes a halogen atom (e.g., chlorine, bromine or fluorine), an aryloxy, carbamoyloxy, carbamoylmethoxy, acyloxy, alkyloxy, sulfonamine or succinimide group in which an oxygen or nitrogen atom is directly bonded at the active point thereof. And a concrete example of the useful coupling split-off groups are such as described in the U.S. Pat. No. 3,471,563, the Japanese Patent L-O-P publications Nos. 47-37425, 50-10135, 50-117422, 50-130441, 51-108841, 50-120334, 52-18315, 53-52423 and 53-105226, and Japanese Patent Publication No. 48-36894.

The compound as shown in the above formula (hereinafter referred to as the Coupler of the Invention) is characterized in that it has acylamino groups at the 2 and 5-positions of phenol respectively and further that one of the said acylamino group has groups $R_1$ and X.

The representative examples of the Coupler of the Invention are given hereunder.

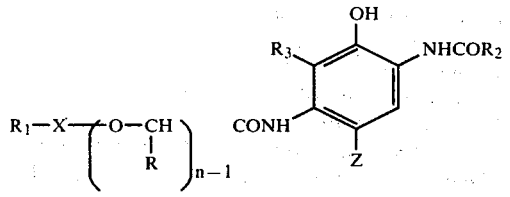

| No. | $R_1$ | X | $R_2$ | $R_3$ | R | n | Z |
|---|---|---|---|---|---|---|---|
| 1 | $CH_3SO_2NH$— | 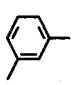 | 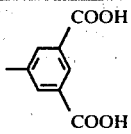 | —H | H | 2 | —H |
| 2 | $C_2H_5SO_2NH$— | 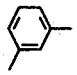 | 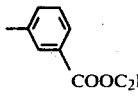 | —H | $—C_{12}H_5$ | 2 | —H |
| 3 | $C_4H_9SO_2NH$— | 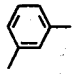 | $—C_2F_4H$ | —H | $—C_{12}H_{25}$ | 2 | 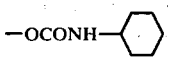 |
| 4 | $C_{12}H_{25}NHSO_2$— | 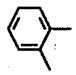 | 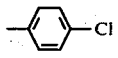 | —H | $—C_4H_9$ | 2 | —H |
| 5 | $C_6H_{13}NHSO_2$— | 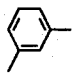 | 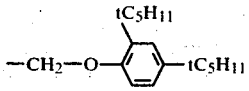 | —H | H | 1 | $—O—CH_2COOCH_3$ |
| 6 | $C_4H_9NHSO_2$— | 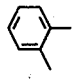 | 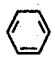 | —H | $—C_{12}H_5$ | 2 | —Cl |
| 7 | $C_{14}H_{29}NHSO_2$— | 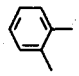 | $—C_3H_7$ | —H | $—C_4H_9$ | 2 | 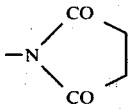 |
| 8 | $C_8H_{17}NHSO_2$— | 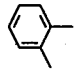 | 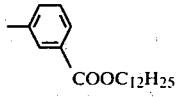 | —H | $—C_2H_5$ | 2 | $—O—CH(CH_3)CONH(CH_2)_2OCH_3$ |
| 9 | $tC_4H_9SO_2NH$— | 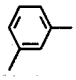 | 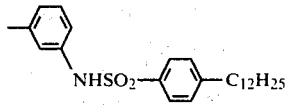 | —H | —H | 2 | —H |

-continued

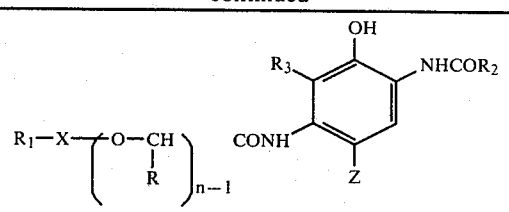

| No. | $R_1$ | X | $R_2$ | $R_3$ | R | n | Z |
|---|---|---|---|---|---|---|---|
| 10 | $C_{16}H_{33}NHSO_2$— | | —$C_6H_4$—$COOC_2H_5$ | —H | —$C_2H_5$ | 2 | —O—$C_6H_4$—$NO_2$ |
| 11 | $C_{16}H_{33}NHSO_2$— | | —$C_3F_7$ | —H | —$C_2H_5$ | 2 | —H |
| 12 | $C_{12}H_{25}NHSO_2$— | | —$C_6H_4$—$COOCH_3$ | —H | —$C_2H_5$ | 2 | —Cl |
| 13 | $CH_3SO_2NH$— | | | —H | —$C_{12}H_{25}$ | 2 | —H |
| 14 | $C_2H_5SO_2NH$— | | —$C_6H_4$—Br | —H | —H | 2 | —OCH(COOH)—COOH |
| 15 | $C_6H_{13}SO_2NH$— | | | —H | —$C_4H_9$ | 2 | —$NHSO_2$—$C_6H_4$—$CH_3$ |
| 16 | $C_4H_9SO_2NH$— | | —$C_2F_4H$ | —H | —$C_{12}H_{25}$ | 2 | —OCONH—$C_6H_4$—$NHCH_2O$—$C_6H_3$(OH)—N=N—$C_6H_2$(Hcl . $NH_2$)($HSO_3$)($SO_3H$) |
| 17 | $CH_3SO_2NH$— | | | —Cl | —$C_{12}H_{25}$ | 2 | Cl |
| 18 | $C_4H_9$—$SO_2$—N(—$CH_2$—$C_6H_5$)— | | | —H | —$C_{12}H_{25}$ | 2 | Cl |

The synthesis examples of the Coupler of the Invention are described as follows:

SYNTHESIS EXAMPLE 1 (EXAMPLE COUPLER 3)

The dissolution of 243.9 g of 2-amino-4-phenylcarbamoyloxy-5-[α-(3-butylsulfonamidephenoxy)tetradecanamide]phenol (of which preparation is made according to the preparing process as described in the Japanese Patent L-O-P publication 52-153923) is made in the solution of 1500 ml of $CH_3CN$ and 39.3 g of triethylamine, and then the solution of 63.3 g of ω-hydrotetrafluoropropanic acid chloride and 100 ml of $CH_3CN$ is dropped therein for 2.5 hours, with heating, refluxing and stirring. After completed the dropping thereof, the further refluxing and stirring are continued for 6.5 hours, and triethylamine hydrochloride deposited therefrom is filtered to separate and the filtered solution is evaporated to dry under reduced pressure and the residue is recrystallized in ligroin to obtain a white solid.

Melting point at 121°–124° C.

Yield 188.5 g

| Values of elementary analysis in percents. | C | H | N | S | F |
|---|---|---|---|---|---|
| Theoretical values | 58.24 | 6.35 | 6.79 | 3.89 | 9.21 |
| Analytical values | 52.16 | 6.31 | 6.84 | 3.91 | 9.16 |

SYNTHESIS EXAMPLE 2 (EXAMPLE COUPLER 13)

(a) Synthesization of the intermediate A, 2-benzamide-5-nitrophenol.

The dissolution of 69.3 g of 2-amino-5-nitrophenol is made in the solution of 1000 ml of $CH_3CN$ and 50.5 g of triethylamine, and 69.9 g of benzoylchloride is dropped therein with heating, refluxing and stirring for 1.5 hours.

After completed the said dropping, and further refluxing and stirring are continued for four hours, and triethylamine deposited therefrom is filtered to separate and the filtered solution is evaporated to dry and the residue thereof is recrystallized in ethylalcohol to obtain a yellow crystals.

Melting point at 281°–284° C.

Yield 88.3 g

| | Values of elementary analysis in percents. | | |
|---|---|---|---|
| | C | H | N |
| Theoretical values | 60.46 | 3.90 | 10.85 |
| Analytical values | 60.41 | 3.89 | 10.79 |

(b) Synthesization of 2-benzamide-5-[α-(2-methylsulfonamidephenoxy)tetradecanamide]phenol.

A hydrogenating reaction of 80 g of 2-benzamide-5-nitrophenol which was obtained in the above process (a) and 0.5 g of Pd/C is made in tetrahydrofurane at room temperature and ordinary pressure. Next, Pd/C is filtered to separate, and the filtered solution thereof is condensed, and the residue thereof is dissolved in the solution of 1500 ml of $CH_3CN$ and 34.8 g of triethylamine, and then 147.2 g of α-(2-methylsulfonamidephenoxy)tetradecanic acid chloride is dropped therein with heating, refluxing and stirring for 2.5 hours. After completed the said dropping, refluxing is continued for eight hours with stirring, and triethylamine hydrochloride deposited therefrom is filtered to separate, and the filtered solution is evaporated to dry under reduced pressure, and the residue thereof is crystallized in n-hexane-alcohol to obtain a white object.

Melting point at 128°–130° C.

Yield 139.1 g

| | Values of elementary analysis in percents. | | | |
|---|---|---|---|---|
| | C | H | N | S |
| Theoretical values | 65.46 | 7.27 | 6.74 | 5.14 |
| Analytical values | 65.49 | 7.26 | 6.71 | 5.21 |

SYNTHESIS EXAMPLE 3 (SYNTHESIS OF THE EXAMPLE COUPLER 11)

(c) Synthesization of the intermediate, 2-parfluorobutanamide-5-nitrophenol

The dissolution of 154.1 g of 2-amino-5-nitrophenol is made in the solution of 1,000 ml of $CH_3CN$ and 106.1 g of triethylamine, and the solution of 279.10 g of perfluorobutanic acid chloride and 200 ml of $CH_3CN$ is dropped therein with heating and refluxing for three hours. After completed the dropping, the refluxing with stirring is continued for eight hours, and triethylamine hydrochloride deposited therefrom is filtered to separate, and the filtered solution thereof is evaporated to dry and recrystallized in methanol/water to obtain an object.

Melting point at 144°–148° C.

Yield 262.6 g

| | Values of elementary analysis in percents. | | | |
|---|---|---|---|---|
| | C | H | N | F |
| Theoretical values | 34.30 | 1.44 | 8.00 | 37.98 |

-continued

| | Values of elementary analysis in percents. | | | |
|---|---|---|---|---|
| | C | H | N | F |
| Analytical values | 34.28 | 1.44 | 7.97 | 38.09 |

(d) Synthesization of 2-parfluorobutanamide-5-[α-(2-hexadecylsulfamoylphenoxy)butanamide]phenol.

A hydrogenating reaction of 250 g of 2-parfluorobutanamide-5-nitrophenol which was obtained in the above process of (c) and 2 g of Pd/C is made in tetrahydrofurane at room temperature and ordinary pressure. Next, Pd/C is filtered to separate, and the filtered solution thereof is condensed, and the residue thereof is dissolved in the solution of 4000 ml of $CH_3CN$ and 80.1 g of triethylamine, and thereafter 394.4 g of α-(hexadecylsulfamoylphenoxy)butanic acid chloride is dropped therein with heating, refluxing and stirring for three hours, and further refluxing with stirring is continued for nine hours. Triethylamine hydrochloride deposited therefrom is filtered to separate, and the filtered solution is evaporated to dry and crystallized in the mixed solvent of n-hexane/alcohol, and thus an object is obtained.

Melting point at 102°–104° C.

Yield 364.7 g

| | Values of elementary analysis in percents. | | | | |
|---|---|---|---|---|---|
| | C | H | N | S | F |
| Theoretical values | 55.02 | 6.41 | 5.35 | 4.08 | 16.92 |
| Analytical values | 55.11 | 6.39 | 5.31 | 4.12 | 16.84 |

The couplers having oil-solubility and alkali-solubility are respectively included in the Couplers of the Invention. Among them, the couplers having oil-solubility can be dispersed, as the so-called oil-protect type coupler, into the silver halide emulsion, after dissolving it into, for example, an organic solvent having high boiling point. And, the couplers having alkali-solubility can be dispersed into the silver halide emulsion by making use of Fischer's method for dispersion, and as for the examples of this type are given as the above described example coupler [16] and so on.

The Couplers of the Invention, for instance, an oil-protect type coupler, can be contained in silver halide emulsion in such method that has so far been known. For example, a one or more of the Coupler of the Invention are dissolved in a single solution of the organic solvent having the high boiling point at 175° C. or higher such as tricresylphosphate, dibutylphthalate, or the solvent having a low boiling point such as butyl acetate, butyl propionate, or in the mixed solution thereof as occasion demands, and then they are mixed in gelatin solution containing surface active agent, and next, the mixture thereof is emulsified by a high speed mixer or colloid mill, and then silver halide is added therein. The result emulsion is coated on a photographic support to obtain a color photographic material.

And, the coupler which is to be added in a color developer, that is, so-called coupler-in-developer, have the advantage because it is easier to add the couplers into a color developer. As a result of the above properties thereof, if the Coupler of the Invention is contained in a photographic sensitive layer of a photographic sensitized material like the so-called coupler-in-emulsion type coupler, etc., the said photographic sensitized material has the advantages that the photographic sensitive layer thereof can be thinned, sharpness of an obtained image is improved, and further harmful interaction is not shown in color development, and particularly color stain and so on are improved owing to the good reactivity thereof.

Coupler of this invention is applicable to diffusion transfer method, and the examples of the couplers most suitable are an illustrated coupler [16] and the like. And when coupler of this invention is added to emulsion of silver halide of this invention, coupler of this invention with the range of about 0.07–0.7 mol and preferable range of 0.1–0.4 mol is added to 1 mol of silver halide normally.

Any silver halide used for silver halide emulsion of this invention, whose example includes such as silver bromide, silver chloride, silver iodobromide, silver chlorobromide and silver chloroiodobromide etc.

Silver halide emulsion can be prepared by a well-known manufacturing process.

Silver halide emulsion used in this invention can be chemically sensitized by a single use or a combined use of a sulfur sensitizer such as allylthiacarbamide, thiourea and cystine, a selenium sensitizer, a reduction sensitizer such as stannous salt and polyamine, a noble metal sensitizer such as gold sensitizer such as potassium aurithiocyanate, potassium chloroaurate, 2-aurosulfobenzthiazolemethylchloride, or water-soluble salt of ruthenium, rhodium or iridium actually ammoniumchloropalladate, potassiumchloroplatinate and sodiumchloropalladite.

Silver halide of this invention can be given a spectral sensitization by the selection of proper sensitizing dye in order to give sensitivity to light-sensitive wavelength range that is necessary for red-sensitive emulsion.

Further, silver halide emulsion of this invention can contain known photographic additives of various kinds.

The color developer used for the invention is the one of which principal component is a color developing agent of aromatic primary amines. As for the concrete examples of the above color developing agents, the ones of p-phenylenediamines are outstanding, e.g., the following are given; diethyl-p-phenylenediamine hydrochloride and monomethyl-p-phenylenediamine hydrochloride, dimethyl-p-phenylenediamine hydrochloride, 2-amino-5-diethylaminotoluene hydrochloride, 2-amino-5-(N-ethyl-N-dodecylamino)-toluene, 2-amino-5-(N-ethyl-N-β-methanesulfonamide ethyl)aminotoluene hydrochloride, 4-(N-ethyl-N-β-methansulfonamide ethylamino)aniline, 4-(N-ethyl-N-β-hydroxyethylamino)aniline, 2-amino-5-(N-ethyl-N-β-methoxyethyl)aminotoluene, etc.

And such color developing agent can be used independently or with combined use of more than two kinds or jointly with black and white developing agent such as hydroquinone etc. in case of need. Further, color developer generally contains alkaline agent such as sodium hydroxide, ammonium hydroxide, sodium carbonate, sodium sulfate and sodium sulfite etc. and may further contain various kinds of additives such as alkali metal halide like potassium bromide or development regulating agent such as citradin acid.

In the color development method used for this invention, after an exposure is given to the light-sensitive material, the color development is made in an ordinary coupler-in-emulsion type color development method. This color developer is exceptionally contained in a photographic material, for example, in the image-receiving material in the diffusion transfer method.

As color developer for the use of the aforesaid coupler-in-emulsion type color, the one with the following composition is given as a typical one, for example.

| [Color developer composition] | |
|---|---|
| 4-amino-3-methyl-N-ethyl-N-(β-methanesulfoneamidoethyl) anilinesulfate | 5.0 g |
| Sodium sulfite (anhydride) | 2.0 g |
| Sodium carbonate (monohydrate) | 50 g |
| Potassium bromide | 1.0 g |
| Potassium hydroxide | 0.55 g |
| Add water to make 1l. | |

The coupler of this invention contained in the color emulsion of this invention reacts with a product oxidized form of color developing agent produced when silver halide is developed with such color developer and forms a cyan dye.

After such color development, the proper combination of each process selected from usual photographic processes, for example, the processes with the processing liquid such as the stopping, the stop-fixing, the fixing, the bleach-fixing, the stabilizing, washing and drying processes.

Next, the typical example of color developing process step applied to coupler-in-emulsion type color negative light-sensitive material, will be shown.

| Process step (33° C.) | Process time |
|---|---|
| Color developing | 3' 15" |
| Bleaching | 6' 30" |
| Washing | 3' 15" |
| Fixing | 6' 30" |
| Washing | 3' 15" |
| Stabilizing | 1' 30" |

Composition of each processor that can be used in the aforesaid process step is as follows, for example.

| [Color developer] | |
|---|---|
| 4-amino-3-methyl-N-ethyl-N-(β-hydroxyethyl)aniline sulfate | 4.8 g |
| Sodium sulfite anhydride | 0.14 g |
| Hydroxyamine ½ sulfate | 1.98 g |
| Sulfuric acid | 0.74 mg |
| Potassium carbonate anhydride | 28.85 g |
| Potassium bicarbonate anhydride | 3.46 g |
| Potassium sulfite anhydride | 5.10 g |
| Potassium bromide | 1.16 g |
| Sodium chloride | 0.14 g |
| 3 sodium salt nitrilo acetic acid (monohydrate) | 1.20 g |
| Potassium hydroxide | 1.48 g |
| Add water to make 1 l | |
| [Bleacher] | |
| Ethylenediaminetetra acetic acid iron ammonium salt | 100 g |
| Ethylenediaminetetra acetic acid 2 ammonium salt | 10 g |
| Ammonium bromide | 150 g |
| Glacial acetic acid | 10 mg |
| Add water to make 1 l and use aqueous ammonia to adjust to pH 6.0. | |
| [Fixer] | |
| Ammonia thiosulfate | 175.0 g |
| Sodium sulfite anhydride | 8.6 g |
| Sodium metasulfite | 2.3 g |
| Add water to make 1 l and use acetic acid to adjust to pH 6.0. | |
| [Stabilizer] | |

-continued

| | |
|---|---|
| Formalin (37% water solution) | 1.5 ml |
| Koniducks (made by Konishiroku Photo Ind. Co., Ltd.) | 7.5 ml |
| Add water to make 1 l | |

Next, another example for the color paper will be given.

| [Process step] Process step (30° C.) | Process time |
|---|---|
| Color developing | 3' 30" |
| Bleach-fixing | 1' 30" |
| Washing | 2' |
| Stabilizing | 1' |

Composition of each processing liquid that can be used in the aforesaid process step is as follows, for example.

| | |
|---|---|
| [Color developer (1)] | |
| 4-amino-3-methyl-N-ethyl-N-(β-methanesulfoneamidoethyl) aniline sulfate | 5.0 g |
| Hexametaphosphoric acid | 2.5 g |
| Sodium sulfite anhydride | 1.85 g |
| Sodium bromide | 1.4 g |
| Potassium bromide | 0.5 g |
| Borax | 39.1 g |
| Add water to make 1 l and use sodium hydroxide to adjust to pH 10.30. | |
| [Color developer (2)] | |
| 4-amino-3-methyl-N-ethyl-N-(β-methanesulfonesulfoneamidoethyl) aniline sulfate | 5.0 g |
| Benzyl alcohol | 15.0 ml |
| Hexametaphosphoric acid | 2.5 g |
| Sodium sulfite anhydride | 1.85 g |
| Sodium bromide | 1.4 g |
| Potassium bromide | 0.5 g |
| Borax | 39.1 g |
| Add water to make 1 l and use sodium hydroxide to adjust to pH 10.3. | |

The aforesaid color developer (1) is a color developer containing no benzyl alcohol, and color developer (2) is a color developer containing benzyl alcohol. In case this invention is used for processing of coupler-in-emulsion type color positive light-sensitive material, both type of color developer (1) and color developer (2) mentioned above can be used and the use of the aforesaid color developer (1) is desirable from the viewpoint of environmental pollution prevention in particular and in this invention, satisfactory photographic characteristic is obtained when this desirable color developer (1) is used.

| | |
|---|---|
| [Bleach-fixer] | |
| Ethylenediaminetetraacetic acid iron ammonium salt | 61.0 g |
| Ethylenediaminetetraacetic acid 2 ammonium salt | 5.0 g |
| Ammonium thiosulfate | 124.5 g |
| Sodium metabisulfite | 13.3 g |
| Sodium sulfite anhydride | 2.7 g |
| Add water to make 1 l | |
| [Stabilizer] | |
| Glacial acetic acid | 20 ml |
| Add water to make 1 l and use sodium acetate to adjust to pH 3.5–4.0. | |

This invention will be explained concretely as follows with the aid of examples.

EXAMPLE (1)

Coupler of this invention shown in table 1 described later and following comparison coupler [A], [B] and [C] are used and 10 g of each coupler are added to the mixture liquid of 2.5 ml of dibutylphthalate and 20 ml of ethyl acetate, respectively and they are warmed to 60° C. and dissolved. This solution is mixed with 5 ml of 10% water solution of alkanol B (alkylnaphthalenesulfonate, produced by Du-Pont) and 200 ml of 5% water solution of gelatin and the mixture is emulsified by a colloid mill to obtain a dispersion of each coupler. Then this coupler dispersion is added to 500 g of gelatin-silver chlorobromide (containing silver bromide of 20 mol%) emulsion and it is coated onto polyethylene coated paper and dried and 6 kinds of silver halide color photographic light-sensitive materials (sample number [1]–[6]) are obtained. After exposure through the wedge, color processing is made thereon in accordance with the color developing process step for the color paper mentioned above as a concrete example and cyan color images are obtained. As for the color developer, 2 kinds of composition liquid, namely, the one with benzyl alcohol added [aforesaid color developer (2)] and the other without benzyl alcohol added [aforesaid color developer (1)] are used. For each sample obtained, photographic characteristics are measured. The results of the measurement are shown in table 1.

TABLE 1

| Sample No. | Coupler used | With benzyl alcohol added: Sensitivity | With benzyl alcohol added: Maximum density (Dmax) | Without benzyl alcohol added: Sensitivity | Without benzyl alcohol added: Maximum density (Dmax) | Maximum absorption wave length (mμ) |
|---|---|---|---|---|---|---|
| 1 | Illustrated coupler - 3 | 100 | 2.20 | 80 | 2.20 | 675 |
| 2 | Illustrated coupler - 5 | 100 | 2.20 | 83 | 2.20 | 655 |
| 3 | Illustrated coupler - 8 | 100 | 2.20 | 80 | 2.20 | 665 |
| 4 | Comparison coupler - A | 100 | 2.20 | 55 | 1.52 | 655 |
| 5 | Comparison coupler - B | 95 | 1.91 | 60 | 1.55 | 664 |
| 6 | Comparison coupler - C | 100 | 1.81 | 50 | 1.53 | 655 |

In the table, the figures in the "sensitivity" column are the relative values against "100" that represents the sensitivity at an addition rate for benzyl alcohol of the sample (4) containing comparison coupler [A]. Comparison couplers [A], [B] and [C] are as follows.

Comparison coupler [A]

6-[α-(2,4-di-tert-amylphenoxy)butaneamine]-2,4-dichloro-3-methylphenol (the one described in the aforesaid U.S. Pat. No. 2,801,171)

Comparison coupler [B]

2-benzamide-5-[α-(4-butylsulfonylaminophenoxy)tetradecaneamide]phenol (the one described in the aforesaid Japanese Patent L-O-P publication No. 53-109630)

Comparison coupler [C]

6-[α-(2,4-di-n-amylphenoxy)butaneamide]-2-chloro-3-methyl-4-(1-phenyl-5-tetrazolyloxy)phenol) (the one described in the aforesaid U.S. Pat. No. 3,839,044)

As is clear from the above-mentioned table 1, it is brought to light that the samples processed by the image forming method of this invention have desirable spectral absorption characteristics and for the color developer to which no benzyl alcohol is added, the maximum density of a color image obtained is higher than any one of comparison couplers [A], [B] and [C].

EXAMPLE (2)

In a similar manner to the aforesaid example (1), samples 7–12 of 6 kinds of light-sensitive materials for the use of cyan color image forming are obtained and the stability against light exposure, heat, and humidity are examined. The results obtained therefrom are shown in table 2.

TABLE 2

| Sample No. | Coupler used | With benzyl alcohol added Stability against | | | Without benzyl alcohol added Stability against | | |
|---|---|---|---|---|---|---|---|
| | | Light | Heat | Humidity | Light | Heat | Humidity |
| 7 | Illustrated coupler - 2 | 91 | 100 | 100 | 90 | 100 | 100 |
| 8 | Illustrated coupler - 6 | 92 | 100 | 100 | 91 | 100 | 100 |
| 9 | Illustrated coupler - 12 | 91 | 100 | 100 | 92 | 100 | 100 |
| 10 | Comparison coupler - A | 91 | 65 | 73 | 90 | 64 | 72 |
| 11 | Comparison coupler - B | 72 | 100 | 98 | 71 | 100 | 97 |
| 12 | Comparison coupler - C | 90 | 65 | 72 | 90 | 65 | 71 |

In the table, the figures for the stability against light represent the remaining ratio of color density in percents after each image is exposed by xenon fade meter for 200 hours to the density before the exposure. The figures for the stability against humidity represent the remaining ratio of color density in percents after the preservation for two weeks under the conditions of 50° C. and relative humidity of 80% to the density before the test. Further, the figures for the stability against heat represent the remaining ratio of color density after the preservation for two weeks under the condition of 77° C. to the density before the test.

As is clear from table 2, comparison couplers [A] and [C] have an favorable property in light stability but they are problematic in heat resistance. Comparison coupler [B], on the other hand, is a coupler having heat resistance which is more improved than that of comparison coupler [A] and [C] but is unsatisfactory in light fastness without benzyl alcohol added. Meanwhile, illustrated couplers [2], [6] and [12] related to this invention have the same heat resistance as that of the aforesaid comparison coupler [B] and an improvement on the point of light fastness is recognized.

EXAMPLE (3)

The aforesaid illustrated coupler [10] of this invention or the aforesaid comparison coupler [A] in the amount of 10 g is added to the mixed liquid of 25 ml of dibutylphthalate and 20 ml of ethyl acetate and they are warmed to 60° C. and dissolved. This solution is mixed with 5 ml of 10% water solution of alkanol B and 200 ml of 5% water solution of gelatin, and the mixture was emulsified by a colloid mill and dispersion liquid of coupler is prepared. Then this dispersion liquid is added to 500 g of the emulsion of high sensitive gelatin silver iodobromide (containing 6.0 mol% of silver iodide) and it is coated onto a celluloseacetate film base and dried to obtain samples 13 and 14. After an exposure in a similar manner to the example 1, color processing is made thereon in accordance with the aforesaid color developing process step for the use of coupler-in-emulsion type color negative, and cyan color images are obtained.

Photographic characteristics are measured on the cyan color images obtained and the results thereof are shown in table 3.

TABLE 3

| Sample No. | Coupler used | Relative sensitivity | Maximum density (Dmax) | Maximum absorption wavelength (λ max) |
|---|---|---|---|---|
| 13 | Illustrated coupler - 10 | 100 | 2.60 | 665 |
| 14 | Comparison coupler - A | 57 | 1.51 | 660 |

As is clear from table 3, it is brought to light that the sample in which the coupler of this invention is used has a high maximum density. And the sample related to this invention had cyan negative color images that are excellent in the transparency.

EXAMPLE (4)

The aforesaid illustrated coupler [28] is added to the emulsion of high sensitive negative silver iodobromide (containing 6 mol% of silver iodide) by means of Fischer's dispersion method (0.2 mol amount was used for each 1 mol of silver halide) and this emulsion is coated onto a triacetate film base and dried.

After a wedgewise exposure in a similar manner to example (1), they are processed for 3 minutes at 24° C.

with an alkaline developer used that has a following composition.

| [Developer composition] | |
|---|---|
| Sodium sulfite | 20 g |
| 4-N-ethyl-N-β-hydroxyethyl-aminoaniline | 11.0 g |
| Add water to make 1 l | |

When this development is made, the image receiving layer of the image receiving material which layer contains dimethyl-β-hydroxyethyl-γ-stearoamidopropylammonium-hydrogenphosphate on polyethylene coated paper, was contacted with the light-sensitive layer of the aforesaid samples and the image receiving material is peeled off after the development. Thereupon, on the image receiving material, a clear cyan positive image with a high maximum density and with an excellent photographic characteristic, is obtained similarly to the aforesaid examples (1), (2) and (3).

EXAMPLE (5)

The illustrated coupler [14] is dissolved in methanol and is added, thus a coupler-in-developer type color developer with a following composition is prepared:

| | |
|---|---|
| N,N-diethyl-2-methyl-p-phenylene-diamine | 2.0 g |
| Sodium sulfite anhydride | 2.0 g |
| Sodium carbonate (1 $H_2O$) | 20.0 g |
| Potassium bromide | 1.0 g |
| Illustrated coupler [26] | 2.0 g |
| Add water to make 1 l. | |

The sample obtained by coating high sensitive silver iodobromide emulsion (containing 5 mol% of silver iodide) onto polyethyleneterephthalate film with subbing, is developed for 30 minutes at 24° C. with the aforesaid coupler-in-developer type color developer after wedgewise exposure.

After the development, processes of washing for 4 minutes, bleaching for 5 minutes, washing for 5 minutes, fixing for 5 minutes, washing for 30 minutes and drying are effected in consecutive order in an ordinary method and as a result thereof, a cyan image with an excellent spectral absorption characteristic with an absorption maximum of 666 nm is obtained.

What is claimed is:

1. A method for forming a cyan dye image by developing an imagewisely exposed silver halide photographic material with a developer containing a color developing agent in the presence of a cyan coupler of the following formula:

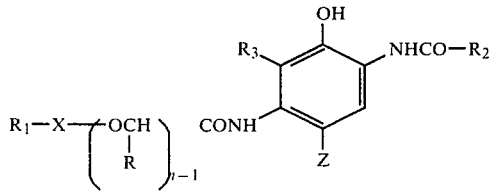

in which R represents a hydrogen atom or an alkyl group having a carbon number of one to twenty; $R_1$ represents an alkylsulfonamide or alkylsulfamoyl group; $R_2$ represents an alkyl, aryl group or a 5 or 6-membered heterocyclic group containing a nitrogen, oxygen or sulfur atom; $R_3$ represents a hydrogen or halogen atom; X represents an alkylene, metaphenylene or orthophenylene group; Z represents a hydrogen atom or a split-off radical; and n has an integral value of one or two.

2. A method according to claim 1 wherein $R_1$ represents an alkylsulfonamide group.

3. A method according to claim 1 or 2 wherein $R_2$ represents an alkyl or aryl group.

4. A method according to claim 3 wherein the alkyl group is tert-butyl group.

5. A method according to claim 3 wherein the aryl group is a phenyl group.

6. A method according to claim 1 wherein $R_3$ represents a hydrogen atom.

7. A method according to claim 1 wherein X represents a metaphenylene or orthophenylene group.

8. A method according to claim 7 wherein X is a metaphenylene group.

9. A method according to claim 7 wherein X is an orthophenylene group.

10. A method according to claim 1 wherein the split-off radical is selected from a group consisting of a halogen atom, an aryloxy, carbamoyloxy, carbamoylmethoxy, acyloxy, alkyloxy, sulfonamide and succinimide group.

11. A method according to claim 10 wherein the split-off radical is a halogen atom.

12. A method according to claim 11 wherein the split-off radical is a chlorine atom.

13. A method according to claim 1 wherein the developer contains no benzylalcohol.

14. A photographic material having a silver halide emulsion layer coated on a support which layer contains a cyan coupler of the following formula:

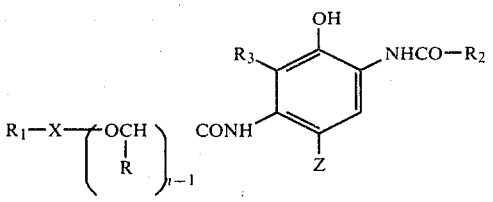

in which R represents a hydrogen atom or an alkyl group having a carbon number of one to twenty; $R_1$ represetns an alkylsulfonamide or alkylsulfamoyl group; $R_2$ represents an alkyl, aryl group or a 5 or 6-membered heterocyclic group containing a nitrogen, oxygen or sulfur atom; $R_3$ represents a hydrogen or halogen atom; X represents an alkylene, metaphenylene or orthophenylene group; Z represents a hydrogen atom or a split-off radical; and n has an integral value of one or two.

15. A photographic material according to claim 14 wherein $R_1$ represents an alkylsulfonamide group.

16. A photographic material according to claim 14 wherein $R_2$ represents an alkyl or aryl group.

17. A photographic material according to claim 14 wherein the alkyl group is tert-butyl group.

18. A photographic material according to claim 14 wherein the aryl group is a phenyl group.

19. A photographic material according to claim 14 wherein $R_3$ represents a hydrogen atom.

20. A photographic material according to claim 14 wherein X represents a metaphenylene or orthophenylene group.

21. A photographic material according to claim 20 wherein X is a metaphenylene group.

22. A photographic material according to claim 20 wherein X is an orthophenylene group.

23. A photographic material according to claim 14 wherein the split-off radical is selected from a group consisting of a halogen atom, an aryloxy, carbamoyloxy, carbamoylmethoxy, acyloxy, alkyloxy, sulfonamide and succinimide group.

24. A photographic material according to claim 23 wherein the split-off radical is a halogen atom.

25. A photographic material according to claim 24 wherein the split-off radical is a chlorine atom.

26. A photographic material according to claim 14 wherein the developer contains no benzylalcohol.

* * * * *